US008519914B2

(12) United States Patent
Kim

(10) Patent No.: US 8,519,914 B2
(45) Date of Patent: Aug. 27, 2013

(54) ORGANIC LIGHT EMITTING DISPLAY DEVICE

(75) Inventor: Yang-Wan Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 361 days.

(21) Appl. No.: 12/869,679

(22) Filed: Aug. 26, 2010

(65) Prior Publication Data

US 2011/0109660 A1 May 12, 2011

(30) Foreign Application Priority Data

Nov. 10, 2009 (KR) ..... 10-2009-0108082

(51) Int. Cl.
*G09G 3/30* (2006.01)

(52) U.S. Cl.
USPC ..... 345/76

(58) Field of Classification Search
USPC ..... 345/76–90, 211, 214, 690
See application file for complete search history.

(56) References Cited

U.S. PATENT DOCUMENTS

| | | | | |
|---|---|---|---|---|
| 6,362,798 | B1 | 3/2002 | Kimura et al. | |
| 7,321,350 | B2 * | 1/2008 | Lee et al. | 345/89 |
| 2008/0231562 | A1 * | 9/2008 | Kwon | 345/77 |
| 2008/0252568 | A1 * | 10/2008 | Kwon | 345/76 |
| 2008/0252570 | A1 * | 10/2008 | Kwon | 345/76 |

FOREIGN PATENT DOCUMENTS

| | | |
|---|---|---|
| JP | 2009-075408 | 4/2009 |
| KR | 10-2006-0022799 | 3/2006 |
| KR | 10-0858615 | 9/2008 |
| KR | 10-0873707 B1 | 12/2008 |
| KR | 10-2009-0020190 | 2/2009 |

OTHER PUBLICATIONS

KIPO Office action dated Apr. 27, 2011, for Korean priority Patent application 10-2009-0108082, noting listed references in this IDS, as well as Korean reference 10-0858615, 1 page.

* cited by examiner

*Primary Examiner* — Kent Chang
*Assistant Examiner* — Scott Au
(74) *Attorney, Agent, or Firm* — Christie, Parker & Hale, LLP

(57) ABSTRACT

An organic light emitting display device includes: pixels at crossing regions of scan lines, light emission control lines, sensing lines, and data lines; a sensor configured to extract deterioration information from organic light emitting diodes included in the pixels during a first sensing period and to extract threshold voltage and mobility information of driving transistors included in the pixels during a second sensing period; a converter configured to generate corrected data by changing input data based on the deterioration information and the threshold voltage and mobility information; and a data driver configured to supply data signals, the data signals being based on the corrected data during a driving period and being reference data signals during the second sensing period, wherein the sensor is configured to extract the threshold voltage and mobility information of the driving transistors using second electric currents from the pixels in response to the reference data signals.

20 Claims, 8 Drawing Sheets

ORGANIC LIGHT EMITTING DISPLAY DEVICE

CROSS-REFERENCE TO RELATED APPLICATION

This application claims priority to and the benefit of Korean Patent Application No. 10-2009-0108082, filed on Nov. 10, 2009, in the Korean Intellectual Property Office, the entire content of which is incorporated herein by reference.

BACKGROUND

1. Field

Embodiments of the present invention relate to organic light emitting display devices.

2. Description of Related Art

A variety of flat panel displays, which may be lighter in weight and smaller in volume than cathode ray tubes, have been recently developed. The types of flat panel displays include liquid crystal displays, field emission displays, plasma display panels, organic light emitting display devices, etc.

An organic light emitting display device displays images using organic light emitting diodes that generate light when an electron and hole are recombined. Such organic light emitting display devices have the advantage of rapid response times and low power requirements (or power demands).

SUMMARY

An aspect of an embodiment of the present invention is directed toward an organic light emitting display device that can display images having desired luminance, regardless of deterioration of an organic light emitting diode and a voltage drop of a first power source.

In one embodiment, there is provided organic light emitting display device that includes: pixels at crossing regions of scan lines, light emission control lines, sensing lines, and data lines; a sensor configured to extract deterioration information from organic light emitting diodes included in the pixels during a first sensing period and configured to extract threshold voltage and mobility information of driving transistors (or activating transistors) during a second sensing period; a converter configured to generate corrected data by changing input data (e.g., a bit of input data) based on the deterioration information and the threshold voltage and mobility information extracted by the sensor; and a data driver configured to supply data signals to the data lines, the data signals being based on the corrected data during a driving (or activation) period in which an image is displayed by the pixels, and configured to supply reference data signals during the second sensing period, wherein the sensor is configured to extract, during the second sensing period, the threshold voltage and mobility information of the driving transistors, using second electric currents that are supplied from the pixels in response to the reference data signals.

In one embodiment, each of the reference data signals corresponds to a gray level at which a maximum electric current is configured to flow in a corresponding one of the pixels.

In one embodiment, each of the pixels positioned in an i-th horizontal line includes: an organic light emitting diode of the organic light emitting diodes having a cathode electrode coupled to a second power source; a first transistor coupled between a data line of the data lines and a first node and having a gate electrode coupled to an i-th scan line of the scan lines; a third transistor coupled between a reference power source and a second node and having a gate electrode coupled to the i-th scan line; a storage capacitor coupled between the first node and the second node; a driving transistor of the driving transistors coupled between a first power source and an anode electrode of the organic light emitting diode, and having a gate electrode coupled to the second node; a fourth transistor coupled between the first power source and the first node and having a gate electrode coupled to an i-th light emission control line of the emission control lines; and a fifth transistor coupled between the anode electrode of the organic light emitting diode and the data line and having a gate electrode connected to an i-th sensing line of the sensing lines.

In one aspect of the present invention, since an organic light emitting display device creates a data signal to compensate for deterioration of an organic light emitting diode and the threshold voltage and mobility formation of a driving transistor, it is possible to display an image having a desired luminance. Further, in one embodiment of the present invention, a pixel is configured to charge a voltage in the storage capacitor substantially independently of a voltage drop of the first power source.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
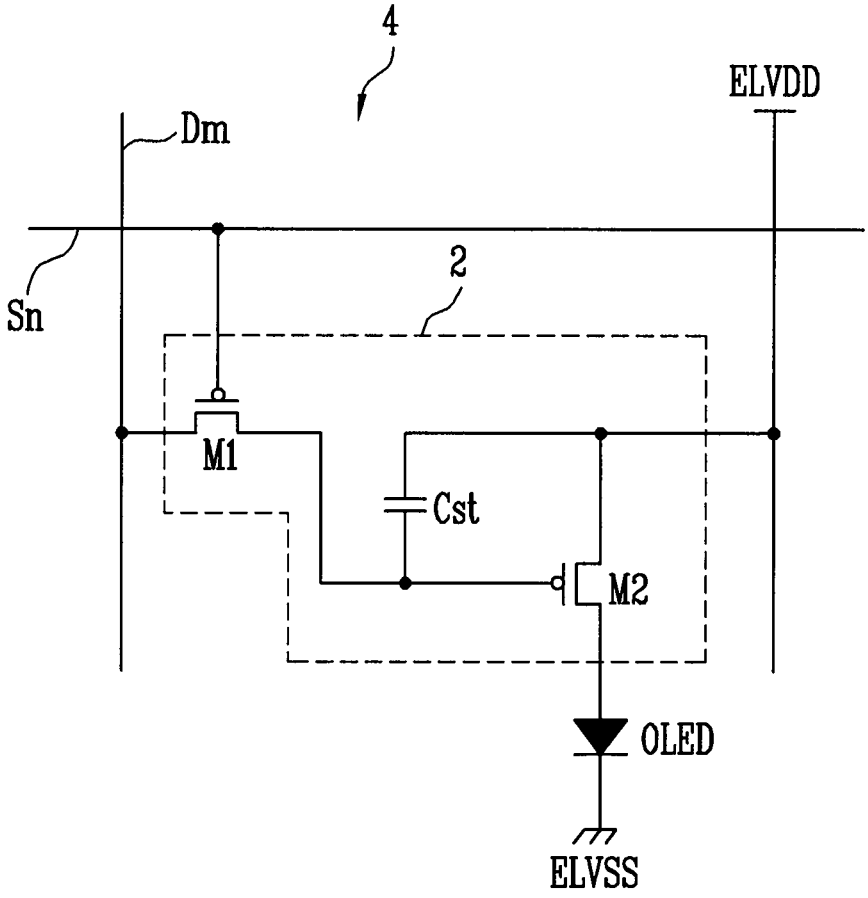
FIG. 1 is a circuit diagram illustrating a pixel of an organic light emitting display device of the related art.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

FIG. 1 is a circuit diagram illustrating a pixel of an organic light emitting display device of the related art.

Referring to FIG. 1, a pixel 4 of an organic light emitting display device of the related art is connected to a data line Dm and a scan line Sn, and has an organic light emitting diode (OLED) and a pixel circuit 2 for controlling the OLED.

An anode electrode of the OLED is connected to the pixel circuit 2 and a cathode electrode is connected to a second power source ELVSS. The OLED emits light with a luminance corresponding to an electric current supplied from the pixel circuit 2.

The pixel circuit 2 controls the amount of electric current that is supplied to the OLED corresponding to a data signal that is supplied to the data line Dm when a scan signal is supplied to the scan line Sn.

In the configuration shown in FIG. 1, the pixel circuit 2 includes a second transistor M2 connected between the first power source ELVDD and the OLED, a first transistor M1 connected with the second transistor M2, the data line Dm, and the scan line Sn, and a storage capacitor Cst connected between a gate electrode and a first electrode of the second transistor.

A gate electrode of the first transistor M1 is connected to the scan line Sn, and a first electrode of the first transistor M1 is connected to the data line Dm. Further, a second electrode of the first transistor is connected to one terminal of the storage capacitor and the gate electrode of the second transistor.

In the context of the present application, a first electrode of a transistor may be either a source electrode or a drain electrode and a second electrode of the transistor may be the other electrode. For example, when the first electrode of the transistor is the source electrode, the second electrode of the transistor is the drain electrode. When a scan signal is supplied to the scan line Sn, the first transistor M1 connected to the scan line Sn and the data line Dm is turned on and supplies a data signal, from the data line Dm to the storage capacitor Cst, which stores a voltage corresponding to the data signal.

The gate electrode of the second transistor M2 is connected to one terminal of the storage capacitor and a first electrode of the second transistor M2 is connected to the other terminal of the capacitor Cst and the first power source ELVDD. Further, a second electrode of the second transistor M2 is connected to the anode electrode of the OLED.

The second transistor M2 having the above configuration controls an amount of electric current flowing from the first power source ELVDD to the second power source ELVSS through the OLED in response to the voltage level stored in the storage capacitor Cst. In this process, the OLED generates light with a luminosity corresponding to the amount of electric current supplied from the second transistor M2.

Organic light emitting display devices having the above configuration may make it difficult to display an image having a desired luminance because deterioration of the OLEDs may change the efficiency of the OLEDs. That is, as the organic light emitting diode (OLED) deteriorates over time, it may generate light having lower luminance in response to the same data signal.

Further, in some organic light emitting display devices, the voltage level of the first power source ELVDD is changed by the position of the pixel 2 in the panel, such that it is difficult to display an image having a desired luminance.

Embodiments of the present invention will be described hereafter with reference to FIGS. 2 to 7.

Figure 2:
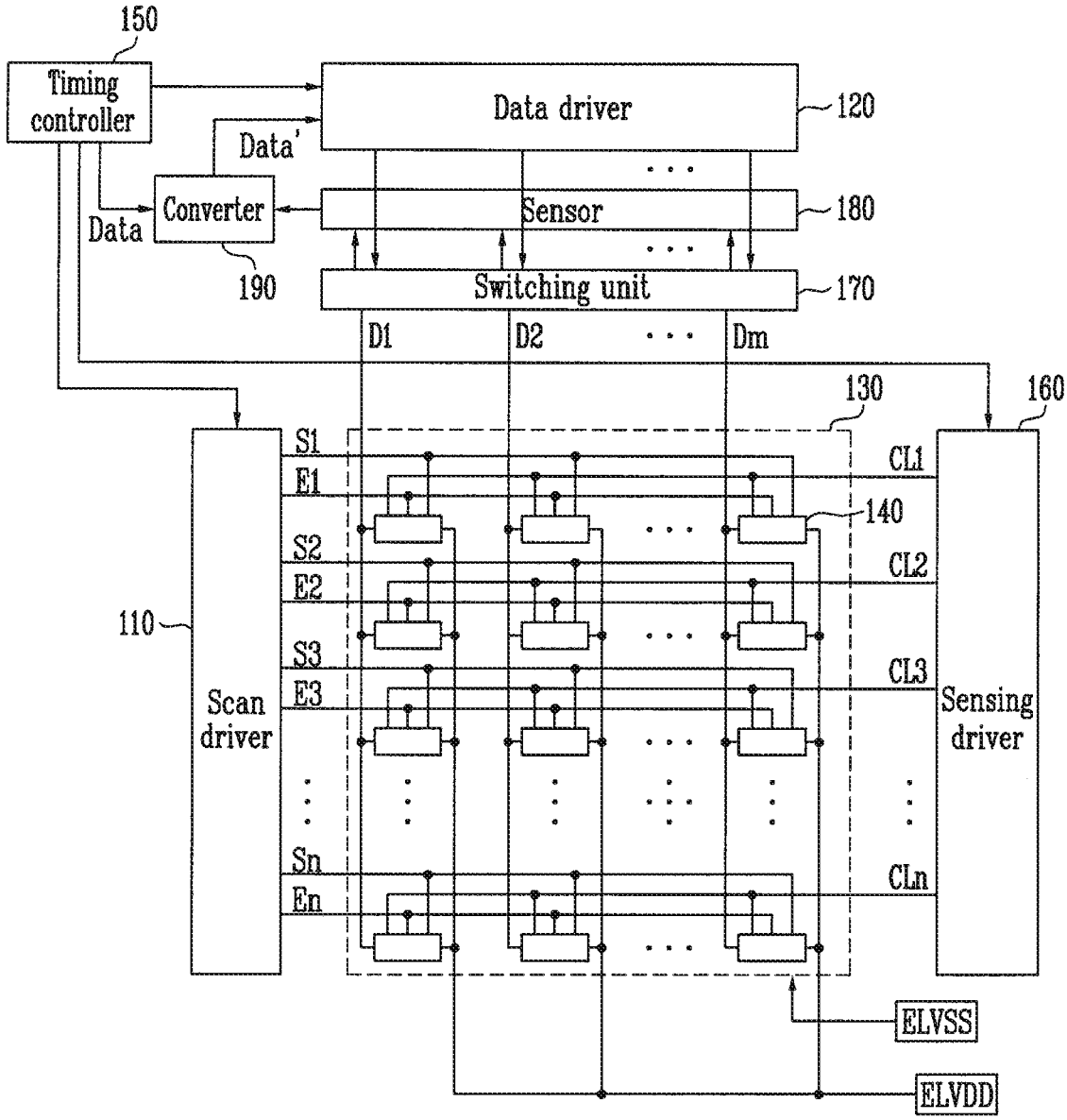
FIG. 2 is a schematic diagram illustrating an organic light emitting display device according to an embodiment of the present invention.

FIG. 2 is a schematic diagram illustrating an organic light emitting display device according to an embodiment of the present invention.

Referring to FIG. 2, an organic light emitting display device according to an embodiment of the present invention includes: a display unit (or pixel unit or display region) 130 including pixels 140 coupled to scan lines S1 to Sn, light emission control lines E1 to En, sensing lines CL1 to CLn, and data lines D1 to Dm; a scan driver 110 that supplies scan signals to the scan lines S1 to Sn and light emission control signals to the light emission control lines E1 to En; a sensing driver 160 that supplies sensing signals to the sensing lines CL1 to CLn; a data driver 120 that activates the data lines D1 to Dm; and a timing controller 150 that controls the scan driver 110, the data driver 120, and the sensing driver 160.

An organic light emitting display device according to an embodiment of the present invention further includes: a sensor 180 that extracts deterioration information of organic light emitting diodes included in the pixels 140 and threshold voltage and mobility information of driving transistors (or activating transistors); a switching unit 170 that selectively connects the sensor 180 or the data driver 120 to the data lines D1 to Dm; a converter 190 that stores the information sensed by the sensor 180 and that uses the sensed information to convert input data Data to corrected data Data' to display images having uniform luminance, regardless of deterioration of the organic light emitting diodes and the threshold voltage and mobility of the driving transistors.

The scan driver 110 supplies scan signals to the scan lines S1 to Sn by control of the timing controller 150. Further, the scan driver 110 supplies light emission signals to the light emission control lines E1 to En by control of the timing controller 150.

The sensing driver 160 supplies sensing signals to the sensing lines CL1 to an by control of the timing controller 150.

The data driver 120 supplies data signals to the data lines D1 to Dm by control of the timing controller 150.

The display unit 130 includes pixels 140 positioned at crossing regions of the light emission control lines E1 to En and the data lines D1 to Dm. The pixels 140 are supplied with powers (e.g., voltages or driving voltages) from the first power source ELVDD and the second power source ELVSS from the outside (or an external source). The pixels 140 control the amount of electric current that is supplied from the first power source ELVDD to the second power source ELVSS through the organic light emitting diodes in response to data signals. In this configuration, the pixels 140 control the amount of electric current flowing to the organic light emitting diodes, regardless of a voltage drop in the power supplied from the first power source ELVDD.

The switching unit 170 selectively connects the sensor 180 and the data driver 120 to the data lines D1 to Dm. In order to achieve this operation, the switching unit 170 includes m pairs of switching elements where each pair of switching elements is coupled to a corresponding one of the data lines D1 to Dm such that there is one pair of switching elements for each channel (or data line).

The sensor extracts deterioration information from the organic light emitting diodes and threshold voltage and mobility information of the driving transistors in the pixels 140 and supplies them to the converter 190. In order to achieve this operation, the sensor 180 includes sensing circuits that are respectively connected with the data lines D1 to Dm (i.e., one sensing circuit for each channel).

In this operation, it is preferable that the extraction of deterioration information from the organic light emitting diodes be performed at a first sensing time before an image is displayed and after power is applied to the organic light emitting display device. That is, the extraction of deterioration information of the organic light emitting diodes may be performed every time power is applied to the organic light emitting display device.

The extraction of threshold voltage and mobility information of the driving transistor may be performed before an image is displayed after power is applied to the organic light emitting display device, or before the organic light emitting display device is initially distributed as a product (e.g., during the manufacturing process), and then the corresponding threshold and mobility information can be provided as (or stored as) information (e.g., predetermined information) when the product is initially distributed. That is, the extraction of threshold voltage and mobility information of the driving transistor may be performed every time power is applied to the organic light emitting display device, or the threshold voltage and mobility information may be retrieved from a value that was stored in advance, without extracting the information every time power is supplied, by storing the information before the product is initially distributed. Hereafter, for the sake of convenience, the period when threshold voltage and mobility information of the driving transistor are extracted is referred to as a second sensing period.

The converter 190 stores the OLED deterioration information and the driving transistor threshold voltage and mobility information supplied from the sensor 180. The converter 190 stores OLED deterioration information and threshold voltage and mobility information of the driving transistors of all of the pixels. In order to achieve this operation, the converter 190 includes a memory and a conversion circuit that converts input data Data transmitted from the timing controller into corrected data Data' to display images having uniform luminance, regardless of the deterioration of the organic light emitting diodes and the threshold voltage and mobility of the driving transistor, using information stored in the memory.

The timing controller 150 controls the data driver 120, the scan driver 110, and the sensing driver 160. Further, the timing controller 150 supplies input data Data transmitted from the outside (or an external source) to the converter 190. The converter 190 uses the input data Data to generate corrected data Data' to compensate for the deterioration of the organic light emitting diodes and the threshold voltage and mobility of the driving transistor. The data driver 120 generates a data signal using the corrected data Data' and supplies the generated data signal to the pixels 140.

Figure 3:
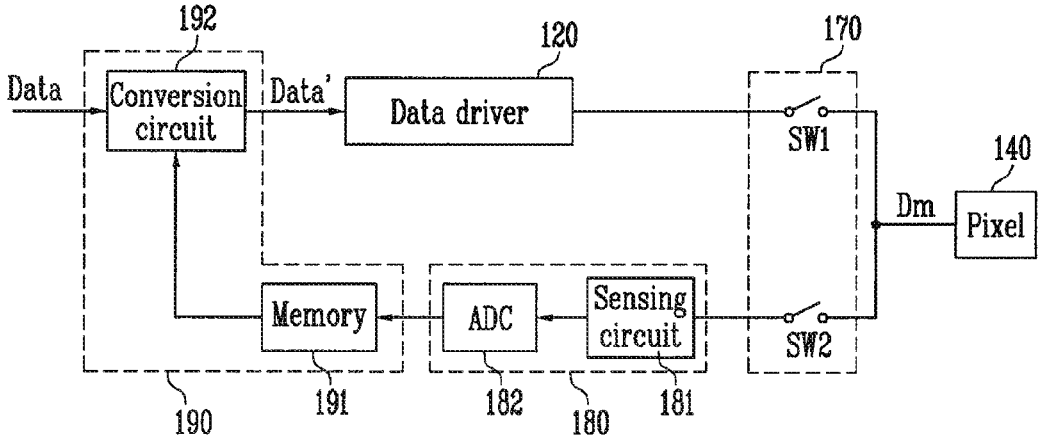
FIG. 3 is a schematic diagram illustrating in detail the switching unit, the sensor, and the converter shown in FIG. 2.

FIG. 3 is a diagram illustrating in detail the switching unit, the sensor, and the converter shown in FIG. 2. The configuration of connections with an m-th data line Dm is shown in FIG. 3 for the sake of convenience.

Referring to FIG. 3, each channel of the switching unit 170 has a pair of switching elements SW1 and SW2. Each channel of the sensor 180 has a sensing circuit 181 and an analog-to-digital converter 182 (hereafter, an "ADC") (alternatively, one ADC may be provided for a plurality of channels or all the channels may share one ADC). The converter 190 includes a memory 191 and a conversion circuit 192.

The first switching element SW1 of the switching unit 170 is disposed between the data driver 120 and the data line Dm. The first switching element SW1 positioned as described above is turned on when a data signal is supplied through the data driver 120. That is, the first switching element SW1 is kept turned-on while the organic light emitting display device operates to display an image (e.g., a predetermined image). Further, the first switching element SW1 is alternately turned on and off with the second switching element SW2 during the second sensing period.

The second switching element SW2 of the switching unit 170 is disposed between the sensor 180 and the data line Dm. The second switching element SW2 positioned as described above is turned on for the first sensing period. Further, the second switching element SW2 is alternately turned off and on with the first switching element SW1 during the second sensing period.

The sensing circuit 181 senses the deterioration information of the OLED by supplying electric current to the pixel 140 and senses the threshold voltage and mobility information of the driving transistor using electric current supplied from the pixel 140.

Figure 4:
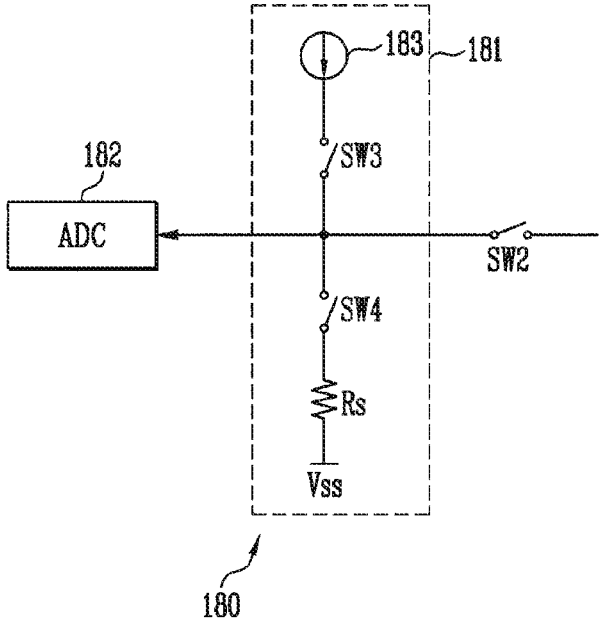
FIG. 4 is a circuit diagram illustrating in detail the sensing circuit shown in FIG. 3.

In order to achieve this operation, the sensing circuit 181, as shown in FIG. 4, includes an electric current source 183, a sensing resistor (or resistance) Rs, a third switching element SW3, and a fourth switching element SW4.

The third switching element SW3 is connected between the electric current source 183 and the second switching element SW2. The third switching element SW3 positioned as described above is turned on during the first sensing period.

The electric current source 183 supplies a first electric current to the pixel 140 during the first sensing period in which the third switching element SW3 is turned on. The first electric current supplied from the electric current source 183 flows through the OLED. In this process, a first voltage corresponding to the first electric current appears across the OLED and deterioration information of the OLED is included in (or encoded in) the first voltage. In detail, the OLED changes in resistance value as it deteriorates. Therefore, the first voltage changes corresponding to the deterioration of the OLED such that it is possible to extract the deterioration information of the OLED.

In addition, the first electric current is variously and suitably set to apply a voltage (e.g., a predetermined voltage) within a time (e.g., a predetermined time). For example, the first electric current may be set to a level that the OLED requires when the pixel 140 emits light with the maximum luminance.

The fourth switching element SW4 is connected between the sensing resistor Rs and the second switching element SW2. The fourth switching element SW4 positioned as described above is turned on for the second sensing period. When the fourth switching element SW4 is turned on, a second electric current is supplied from the driving transistor included in the pixel 140, in response to a reference data signal. The second electric current flows from the pixel 140 to a third power source Vss thorough the fourth switching element SW4 and the sensing resistor Rs. In this process, a second voltage corresponding to the second electric current appears across the sensing resistor Rs. Therefore, the second electric voltage includes (or encodes) the threshold voltage and mobility information of the driving transistor. The process through which the second electric current is supplied from the pixel 140 is described below in more detail.

The ADC 182 converts the first voltage into a first digital value and the second voltage into a second digital value and then supplies the values to the converter 190.

The converter 190 includes a memory 191 and a conversion circuit 192.

The memory 191 stores the first digital value and the second digital value supplied from the ADC 182. The memory 191 stores deterioration information of the OLEDs and threshold and mobility information of the driving transistors of all of the pixels 140 included in the display unit 130.

The conversion circuit 192 generates corrected data Data' by changing the input data Data (e.g., a bit of an input data Data) to compensate for the deterioration of the OLED and the threshold voltage and mobility information of the driving transistor M2 using the first digital value and the second digital value stored in the memory 191.

The data driver 120 creates a data signal using the corrected data Data' for the driving (or activation) period and supplies the created data signal to the pixel 140. Further, the data driver 120 supplies reference signals to the data lines D1 to Dm when the first switching element SW1 is turned on during the second sensing period. The reference data signals are set such that the maximum electric current (i.e., the second electric current) which can flow in the pixel 140 flows. For example, the data driver 120 can supply a data signal corresponding to a white gray level as a reference data signal.

Figure 5:
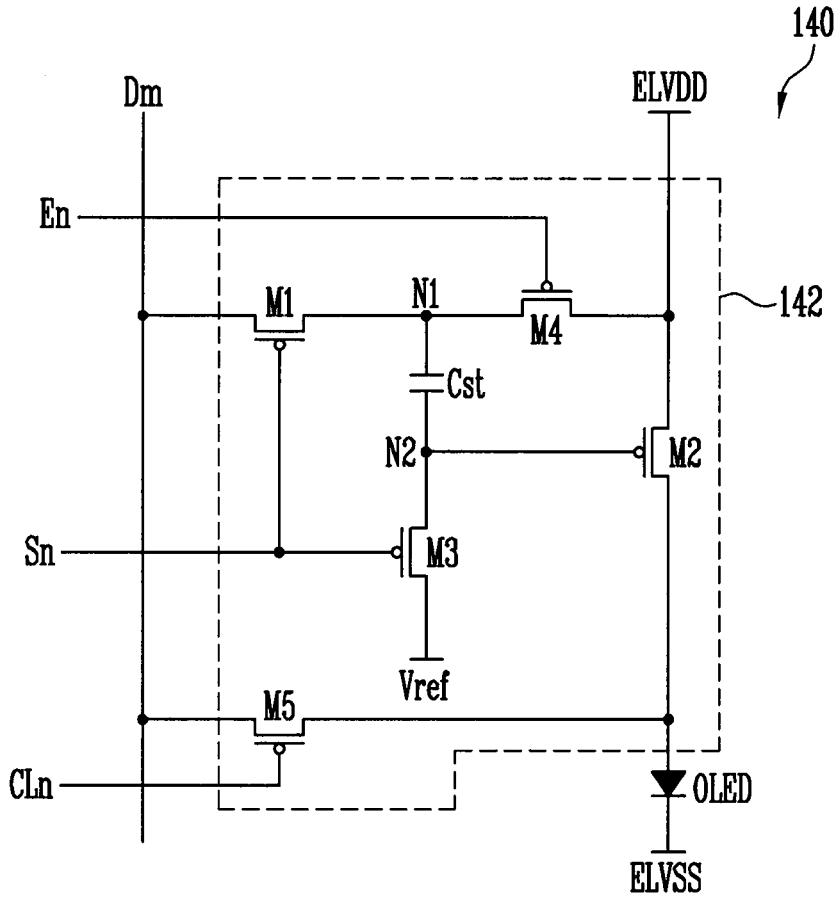
FIG. 5 is a circuit diagram illustrating a first embodiment of the pixel shown in FIG. 2.

FIG. 5 illustrates a first embodiment of a pixel 140 shown in FIG. 2, in which, for the sake of convenience, the pixel is connected to the m-th data line Dm and the n-th scan line Sn.

Referring to FIG. 5, the pixel 140 according to an embodiment of the present invention includes an OLED and a pixel circuit 142 for supplying electric current to the OLED. For the sake of convenience, a pixel coupled to emission control line En, scan line Sn, sensing line CLn, and data line Dm is illustrated.

The OLED generates light of a color (e.g., a predetermined color), corresponding to the electric current supplied from the pixel circuit 142. For example, the OLED creates red, green, and/or blue light which has a luminance (e.g., a predetermined luminance) corresponding to the amount of electric current supplied from the pixel circuit 142.

The pixel circuit 142 is charged with a voltage corresponding to reference voltage Vref and a data signal and supplies electric current corresponding to the charged voltage to the OLED. Further, the pixel circuit 142 supplies deterioration information of the OLED or threshold voltage and mobility information of the driving transistor (e.g., the second transistor M2) to the sensor 180 when a sensing signal is supplied to the sensing line CLn. In order to achieve this operation, the pixel circuit 142 includes five transistors M1 to M5 and a storage capacitor Cst.

A first electrode of the first transistor M1 is connected to the data line Dm, and the second electrode of the first transistor M1 is connected to a first node N1. Further, a gate electrode of the first transistor M1 is connected to the scan line Sn. The first transistor M1 having the above configuration electrically connects the data line Dm with the first node N1 when it is turned on, that is, when a scan signal is supplied to the scan line Sn. The scan signal is supplied during the driving period and the second sensing period.

A first electrode of the second transistor M2 is connected to the first power source ELVDD, and a second electrode of the second transistor M2 is connected to the OLED. Further, a gate electrode of the second transistor M2 is connected to a second node N2. The second transistor M2 having the above configuration supplies an electric current which corresponds to a voltage applied to the second node N2, that is, a voltage corresponding to the voltage charged in the storage capacitor Cst, to the OLED.

A first electrode of the third transistor M3 is connected to the second node N2, and a second electrode of the third transistor M3 is connected to the reference power source Vref. Further, a gate electrode of the third transistor M3 is connected to the scan line Sn. The third transistor M3 having the above configuration electrically connects the reference power source Vref with the second node N2 when it is turned on, that is, when a scan signal is supplied to the scan line Sn.

A first electrode of the fourth transistor M4 is connected to the first power source ELVDD, and a second electrode of the fourth transistor M4 is connected to the first node N1. Further, the gate electrode of the fourth transistor M4 is connected to the light emission control line En. The fourth transistor M4 having the above configuration is turned on when a light emission control signal is supplied, and turned off when a light emission control signal is not supplied. The light emission control signal is supplied on an emission control line En for a period in which a data signal is supplied to the pixel 140 connected with the emission control line En during the driving period (that is, while the data signal is being applied to the capacitor Cst). Further, the light emission control signal is supplied to overlap in time with a scan signal for the second sensing period.

The fifth transistor M5 is disposed between the data line Dm and the anode electrode of the OLED. Further, a gate electrode of the fifth transistor M5 is connected to the sensing line CLn. The fifth transistor M5 having the above configuration is turned on when a sensing signal is supplied to the sensing line CLn, and turned off in other cases. The sensing signals are sequentially supplied to the sensing lines CL1 to CLn for the first sensing period and the second sensing period.

The first terminal of the storage capacitor Cst is connected to the first node N1, and the second terminal is connected to the second node N2. The storage capacitor Cst having the above configuration is charged with voltage corresponding to the reference power source Vref and a data signal. In order to achieve this operation, the data signal is set to a voltage that is the same as or higher than a voltage supplied from the reference power source Vref. Further, the data signal is set to a voltage lower than the first power source ELVDD.

The first power source ELVDD is connected to the pixels 140 and supplies an electric current (e.g., a predetermined electric current) to them, such that different voltage drops occur in accordance with the positions of the pixels 140 in the display unit 130. However, because the reference power source Vref may not (or does not) supply a significant electric current to each pixel 140, it is possible to supply substantially the same voltage level to all of the pixels 140, regardless of the position of the pixels 140.

Figure 6A:
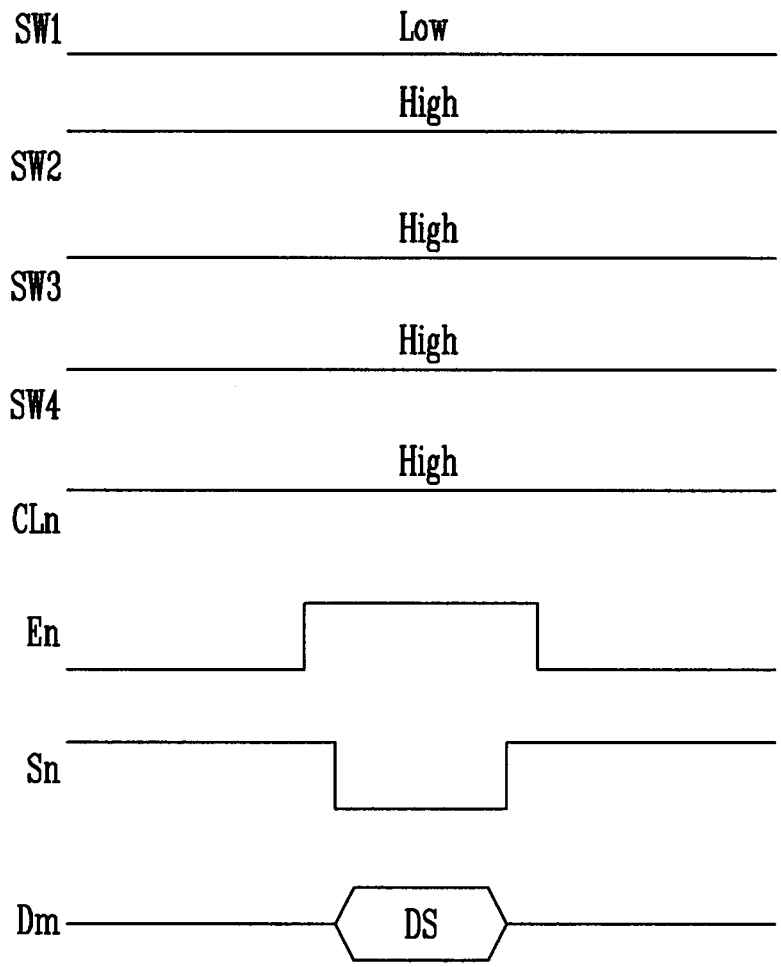
FIGS. 6A, 6B, and 6C are waveform views illustrating a method of activating the pixel shown in FIG. 5.

FIG. 6A is a waveform view showing driving waveforms that are supplied for the driving period. Driving waveforms supplied to the pixel 140 connected with the n-th scan line Sn and the m-th data line Dm is shown in FIG. 6A for the sake of convenience.

Referring to FIG. 6A, for the driving period, the first switching element SW1 is turned on, and the second switching element SW2 to the fourth switching element SW4 are turned off. Further, during the driving period, a sensing signal is not supplied to the sensing lines CL1 to CLn. In addition, during the driving period, light emission control signals are sequentially supplied to the light emission control lines E1 to En and scan signals are sequentially supplied to the scan lines S1 to Sn.

In this process, the scan signal that is supplied to the i-th scan line Si (i is a natural number, e.g., i=n) completely overlaps in time with the light emission control signal that is supplied to the i-th light emission control line Ei. In order to achieve this, the light emission control signal is set to be wider (or have a longer period) than the scan signal. Further, data signals are supplied to the data lines D1 to Dm in synchronization with the scan signals sequentially supplied to the scan lines S1 to Sn during the driving period.

Describing the operational process in more detail, for the driving period, the conversion circuit 192 generates corrected data Data', using the first digital value and the second digital value stored in the memory 191. The corrected data Data' is created by changing the data Data (e.g., a bit of the data Data) to compensate for deterioration of the OLED and the threshold voltage and mobility of the second transistor M2. The corrected data Data' generated by the conversion circuit 192 is supplied to the data driver 120, and the data driver 120 generates a data signal DS using the corrected data Data'.

On the other hand, when a light emission control signal is supplied to the light emission control line En for the driving period, the fourth transistor M4 is turned off. As the fourth transistor M4 is turned off, the electrical connection between the first node N1 and the first power source ELVDD is cut.

Thereafter, a scan signal is supplied to the scan line Sn, such that the first transistor M1 and the third transistor M3 are turned on. When the first transistor M1 is turned on, a data signal DS is supplied from the data line Dm to the first node N1. When the third transistor M3 is turned on, the voltage of the reference power source Vref is supplied to the second node N2. In this process, the storage capacitor Cst is charged with a voltage corresponding to a difference between the reference power source and the data signal.

Therefore, the voltage stored in the storage capacitor Cst does not depend on a voltage supplied from the first power source ELVDD. That is, the desired voltage (e.g., a voltage corresponding to a data signal supplied via a data line) is charged in the storage capacitor Cst, regardless of a voltage drop in the voltage supplied from the first power source ELVDD.

Supply of the scan signal and the light emission control signal is stopped after the storage capacitor Cst is charged with the desired voltage (e.g., a predetermined voltage). When the supply of the scan signal to the scan line Sn is stopped, the first transistor M1 and the third transistor M3 are turned off. When the supply of the light emission control signal to the light emission control line En is stopped, the fourth transistor M4 is turned on.

When the fourth transistor M4 is turned on, the voltage of the first power source ELVDD is supplied to the first node N1. In this process, the second node N2 is set to a floating state, such that the voltage of the second node N2 changes in accordance with the change in voltage of the first node N1 and, as a result, this compensates for the voltage drop of the first power source ELVDD.

In more detail, the larger the voltage drop of the first power source ELVDD, the smaller the change (e.g., increase) in voltage at the first node N1. For example, when a voltage supplied from the first power source ELVDD is 5V and the voltage at the first node N1 is 3V in a first pixel, the voltage of the first node N1 increases by 2V when M4 is turned on. Further, in a second pixel, when a voltage supplied from the first power source ELVDD is 4V and the voltage at the first node N1 is 3V, the voltage at the first node N1 increases by 1V when M4 is turned on.

In this case, the voltage between the gate electrode and the source electrode of the second transistor M2 can be kept constant, regardless of the voltage drop of the first power source ELVDD, and accordingly, the voltage drop of the first power source ELVDD can be compensated. In other words, the larger the voltage drop of the first power source ELVDD, the smaller the change in voltage at the gate electrode of the second transistor M2, and accordingly, this compensates for the voltage drop of the first power source ELVDD.

In addition, the voltage charged in (or the voltage across) the storage capacitor Cst is kept constant, without changing, even if the voltage of the first node N1 is changed by a ripple of the first power source ELVDD. For example, when the voltage of the first node N1 is increased by the ripple of the first power source ELVDD, the voltage of the second node N2 also increases, such that the voltage charged in the storage capacitor Cst is kept constant, regardless of the ripple of the first power source ELVDD, and accordingly, it is possible to reduce or prevent flicker due to ripples in the first power source ELVDD.

As described above, since the pixel 140 according to an embodiment of the present invention charges the storage capacitor Cst using the data signal created by the corrected data Data', it is possible to compensate for deterioration of the OLED. Further, in the present invention, it is possible to display an image having desired luminance, regardless of a voltage drop and a ripple of the first power source ELVDD.

Figure 6B:
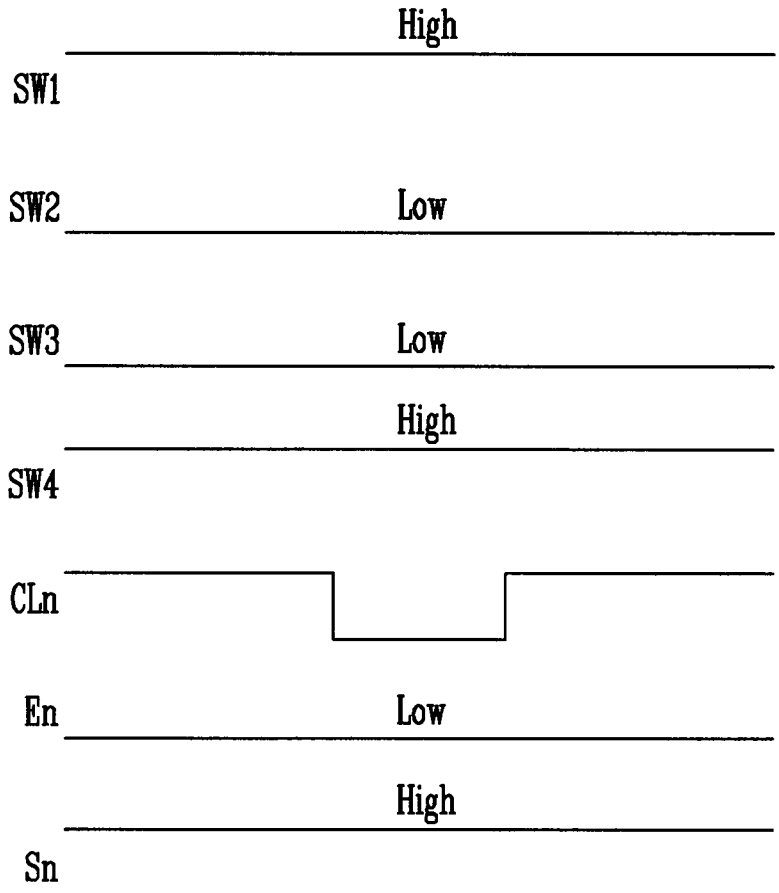

FIG. 6B is a waveform view showing waveforms that are supplied during the first sensing period. Driving waveform supplied to the pixel 140 connected to the n-th scan line Sn and the m-th data line Dm is shown in FIG. 6B for the sake of convenience.

Referring to FIG. 6B, during the first sensing period, the first switching element SW1 and the fourth switching element SW4 are turned off, and the second switching element SW2 and the third switching element SW3 are turned on. Further, during the first sensing period, a light emission control signal and a scan signal are not supplied, while sensing signals are sequentially supplied to the sensing lines CL1 to CLn.

When a sensing signal is supplied to the n-th sensing line CLn, the fifth transistor M5 is turned on. As the fifth transistor M5 is turned on, the data line Dm is connected with the anode electrode of the OLED. When the fifth transistor M5 is turned on, the first electric current supplied from the electric current source 183 is supplied to the second power source ELVSS through the OLED. In this process, a first voltage appears across the OLED, and the first voltage is changed into a first digital value by the ADC 182 and then stored in the memory 191. Practically, for the first sensing period, sensing signals are sequentially supplied to the sensing lines CL1 to CLn, and the first digital values corresponding to all the pixels 140 are stored in the memory 191.

Figure 6C:
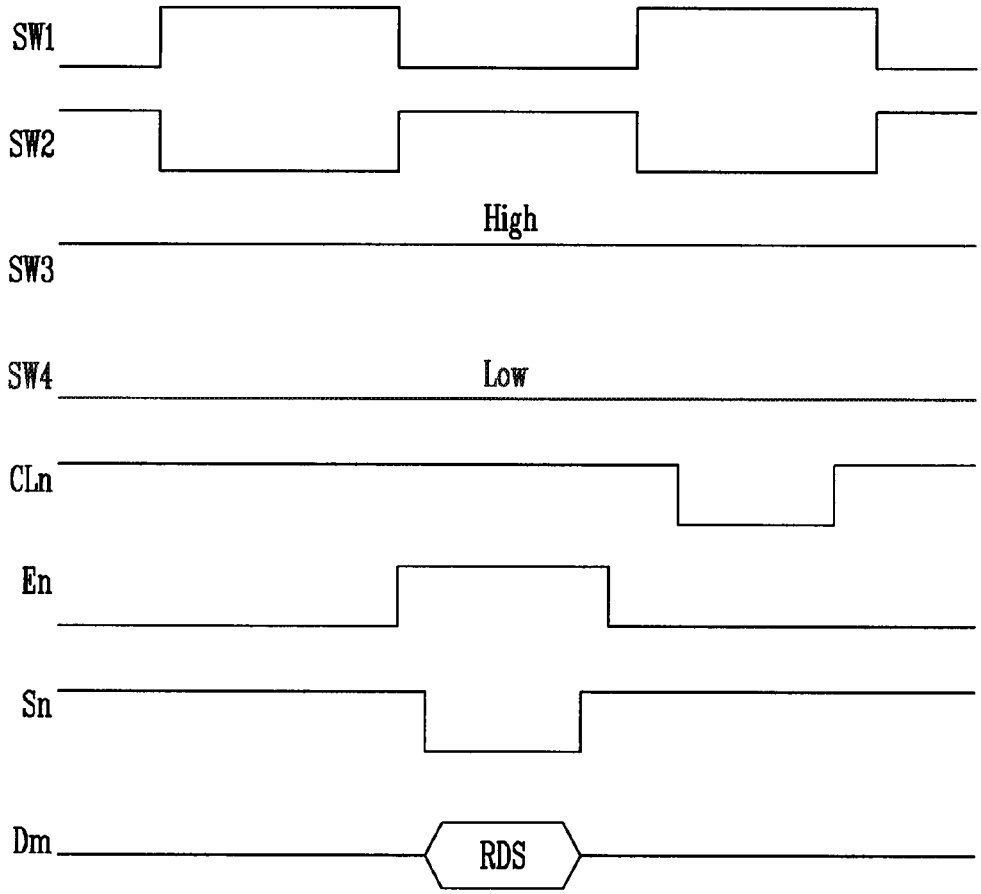

FIG. 6C is a waveform view showing driving waveforms that are supplied for the second sensing period. Driving waveforms that are supplied to the pixel 140 connected with the n-th scan line Sn and the m-th data line Dm are shown in FIG. 6C for the sake of convenience.

Referring to FIG. 6C, during the second sensing period, the first switching elements SW1 and the second switching elements are alternately and repeatedly turned on and off. Further, the scan driver 110 sequentially supplies light emission control signals to the light emission control lines E1 to En during the second sensing period and also sequentially supplies scan signals to the scan lines S1 to Sn. The light emission control signals and the scan signals which are supplied to the light emission control lines E1 to En and the scan lines S1 to Sn, respectively, are supplied to overlap in time with the turning-on time of the first switching element SW1. Further, the sensing driver 160 sequentially supplies sensing signals to the sensing lines CL1 to CLn for the second sensing period. The sensing signals supplied to the sensing lines CL1 to CLn are supplied to overlap in time with the turning-on time of the second switching element SW2.

In addition, fourth switching element SW4 is kept turned-on, and the third sensing switching element SW3 is kept turned-off during the second sensing period. The fourth switching element SW4 may be repeatedly turned on and off, the same as (or at the same time as) the second switching element SW2.

Describing the operational process in more detail, first, a light emission control signal is supplied to the light emission control line En, and a scan signal is supplied to the scan line Sn while the first switching element SW1 is turned on.

When the light emission control signal is supplied to the light emission control line En, the fourth transistor M4 is turned off. When the fourth transistor M4 is turned off, the electrical connection between the first node N1 and the first power source ELVDD is cut.

When the scan signal is supplied to the scan line Sn, the first transistor M1 and the third transistor M3 are turned on. When the first transistor M1 is turned on, a reference data signal RDS is supplied from the data line Dm to the first node N1. When the third transistor M3 is turned on, the voltage of the reference power source Vref is supplied to the second node N2. In this process, the storage capacitor Cst is charged with voltage corresponding to a difference between the reference power source Vref and the reference data signal RDS.

In this process, the storage capacitor Cst is charged with a voltage that does not depend on a voltage supplied from the first power source ELVDD. Therefore, the desired voltage (e.g., a voltage corresponding to the data signal supplied via the data line) is charged in the storage capacitor Cst regardless of a voltage drop of the first power source ELVDD.

Supply of the scan signal and the light emission control signal are stopped after the capacitor is charged with a voltage (e.g., a predetermined voltage). When the supply of the scan signal to the scan line Sn is stopped, the first transistor M1 and the third transistor M3 are turned off. When the supply of the light emission control signal to the light emission control line En is stopped, the fourth transistor M4 is turned on.

When the fourth transistor M4 is turned on, the voltage of the first power source ELVDD is supplied to the first node N1. In this process, since the second node N2 is set to a floating state, the voltage of the second node N2 changes in accordance with the voltage change of the first node N1, and accordingly, this compensates for the voltage drop of the first power source ELVDD.

Thereafter, the first switching element SW1 is turned off and the second switching element SW2 is turned on. Further, a sensing signal is supplied to the sensing line CLn for at least a portion of the period in which the second switching element SW2 is turned on. When the sensing signal is supplied to the sensing line CLn, the fifth transistor M5 is turned on.

When the fifth transistor M5 is turned on, a second electric current that is supplied to the second transistor M2 corresponding to the voltage applied to the second node N2 is supplied to the third power source Vss through the fifth transistor M5, the data line Dm, the second switching element SW2, the fourth switching element SW4, and the sensing resistor Rs. In this process, a second voltage corresponding to the second electric current supplied from the second transistor M2 appears across the sensing resistor Rs, and the second voltage is converted into a second digital value by the ADC 182 and then stored in the memory 191.

The voltage of the third power source Vss in an embodiment of the present invention is set such that the second electric current can flow from the pixel 140 through the sensing resistor Rs. For example, the third power source Vss may be substantially the same as the voltage of the second power source ELVSS at a low level. Further, the second power source ELVSS may be set to a high-level voltage such that the second electric current does not flow through the second transistor M2 to the second power source ELVSS during the second sensing period.

Figure 7:
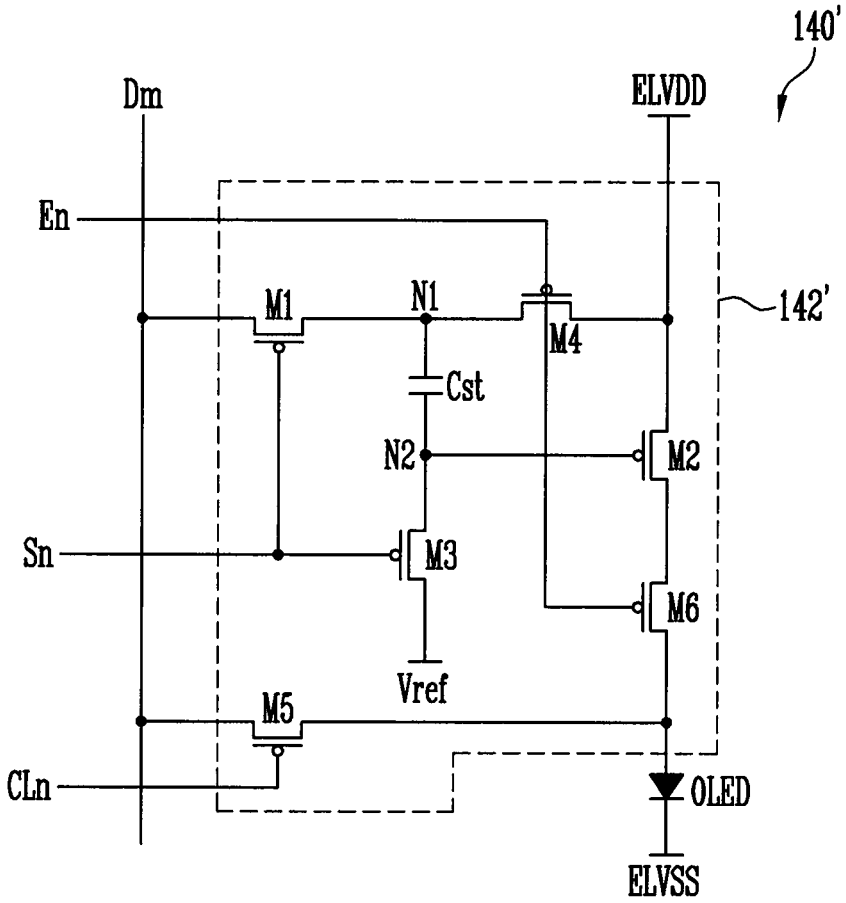
FIG. 7 is a circuit diagram illustrating a second embodiment of the pixel shown in FIG. 2.

FIG. 7 is a circuit diagram illustrating a second embodiment of the pixel shown in FIG. 2. In describing FIG. 7, components that are the same as in FIG. 5 are designated by the same reference numerals and a detailed description of these components is not provided.

Referring to FIG. 7, a pixel 140' according to the second embodiment of the present invention includes an OLED and a pixel circuit 142' for supplying electric current to the OLED.

The pixel circuit 142' further includes a sixth transistor M6 connected between the second transistor M2 and the OLED, in contrast with the configuration shown in FIG. 5. The gate electrode of the sixth transistor M6 is connected to the light emission control line En and is turned off when a light emission control signal is supplied.

The sixth transistor M6 is used to stop the electric current that is supplied to the organic light emitting diode in response to the light emission control signal that is supplied from the light emission control line En. In this case the pixel 140' according to the second embodiment of the present invention can freely adjust the light emitting time of the pixel 140', using the width of the light emission control signal.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display device, comprising:

pixels at crossing regions of scan lines, light emission control lines, sensing lines, and data lines;

a sensor configured to extract deterioration information from organic light emitting diodes included in the pixels during a first sensing period and configured to extract threshold voltage and mobility information of driving transistors included in the pixels during a second sensing period;

a converter configured to generate corrected data by changing input data based on the deterioration information and the threshold voltage and mobility information extracted by the sensor;

a data driver configured to supply data signals to the data lines, the data signals being based on the corrected data during a driving period in which an image is displayed by the pixels and the data signals being reference data signals during the second sensing period; and a switching unit coupled to the data lines for selectively connecting the data lines with the data driver or the sensor, the switching unit comprising a sensing circuit configured to extract the deterioration information and the threshold voltage and mobility information, wherein the sensor is configured to extract, during the second sensing period, the threshold voltage and mobility information of the driving transistors utilizing second electric currents that are supplied from the pixels in response to the reference data signals, and wherein the sensing circuit comprises:

an electric current source coupled to a data line of the data lines and configured to supply a first electric current the data line during the first sensing period;

a third switching element coupled between the electric current source and the switching unit;

a sensing resistor configured to be supplied with a second electric current of the second electric currents from a corresponding one of the pixels; and a fourth switching element coupled between the sensing resistor and the switching unit.

2. The organic light emitting display device as claimed in claim 1, wherein each of the reference data signals corresponds to a gray level at which a maximum electric current is configured to flow in a corresponding one of the pixels.

3. The organic light emitting display device as claimed in claim 2, wherein each of the reference data signals corresponds to a white gray level.

4. The organic light emitting display device as claimed in claim 1, wherein the switching unit further comprises:

a first switching element coupled between a data line of the data lines and the data driver, configured to be kept turned-on during the driving period and configured to be repeatedly turned on and off during the second sensing period; and a second switching element coupled between the data line and the sensor, configured to be kept tuned-on during the first sensing period, and configured to be alternately turned on and off with the first switching element during the second sensing period.

5. The organic light emitting display device as claimed in claim 4, further comprising:

a scan driver configured to sequentially supply scan signals to the scan lines while sequentially supplying light emission control signals to the light emission control lines during the driving period and the second sensing period; and a sensing driver configured to sequentially supply sensing signals to the sensing lines during the first sensing period and the second sensing period.

6. The organic light emitting display device as claimed in claim 5, wherein the scan driver is configured to supply a scan signal of the scan signals to an i-th scan line of the scan lines and a light emission control signal of the light emission control signals to an i-th light emission control line of the light emission control lines such that the scan signal completely overlaps in time with the emission control signal.

7. The organic light emitting display device as claimed in claim 5, wherein the scan driver is configured to supply a scan signal of the scan signals and a light emission control signal of the light emission control signals such that the scan signal and the light emission control signal overlap in time with a period in which the first switching element is turned on during the second sensing period.

8. The organic light emitting display device as claimed in claim 5, wherein the sensing driver is configured to supply a sensing signal of the sensing signals to overlap in time with a period in which the second switching element is turned on during the second sensing period.

9. The organic light emitting display device as claimed in claim 1, wherein the sensor further includes:

an analog-to-digital converter configured to convert the deterioration information into a first digital value and the threshold voltage and mobility information into a second digital value.

10. The organic light emitting display device as claimed in claim 1, wherein the analog-to-digital converter is configured to convert a first voltage that appears across a corresponding one of the organic light emitting diodes when the first electric current is supplied into the first digital value, and converts a second voltage that appears across the sensing resistor, in response to the second electric current, into the second digital value.

11. The organic light emitting display device as claimed in claim 1, wherein the third switching element is configured to be kept turned-on during the first sensing period.

12. The organic light emitting display device as claimed in claim 1, wherein the fourth switching element is configured to be kept turned-on during the second sensing period.

13. The organic light emitting display device as claimed in claim 1, wherein the converter includes:

a memory configured to store the deterioration information and the threshold voltage and mobility information; and a conversion circuit configured to generate the corrected data using the deterioration information and the threshold voltage and mobility information stored in the memory.

14. An organic light emitting display device, comprising:

pixels at crossing regions of scan lines, light emission control lines, sensing lines, and data lines;

a sensor configured to extract deterioration information from organic light emitting diodes included in the pixels during a first sensing period and configured to extract threshold voltage and mobility information of driving transistors included in the pixels during a second sensing period;

a converter configured to generate corrected data by changing input data based on the deterioration information and the threshold voltage and mobility information extracted by the sensor; and a data driver configured to supply data signals to the data lines, the data signals being based on the corrected data during a driving period in which an image is displayed by the pixels and the data signals being reference data signals during the second sensing period, wherein the sensor is configured to extract, during the second sensing period, the threshold voltage and mobility information of the driving transistors utilizing second electric currents that are supplied from the pixels in response to the reference data signals, and wherein each of the pixels located in an i-th horizontal line comprises:

an organic light emitting diode of the organic light emitting diodes having a cathode electrode coupled to a second power source;

a first transistor coupled between a data line of the data lines and a first node and having a gate electrode coupled to an i-th scan line of the scan lines;

a third transistor coupled between a reference power source and a second node and having a gate electrode coupled to the i-th scan line;

a storage capacitor coupled between the first node and the second node;

a driving transistor of the driving transistors coupled between a first power source and an anode electrode of the organic light emitting diode, and having a gate electrode coupled to the second node;

a fourth transistor coupled between the first power source and the first node and having a gate electrode coupled to an i-th light emission control line of the emission control lines; and a fifth transistor coupled between the anode electrode of the organic light emitting diode and the data line and having a gate electrode connected to an i-th sensing line of the sensing lines.

15. The organic light emitting display device as claimed in claim 14, wherein each of the pixels is configured to charge a voltage in the storage capacitor substantially independently of a voltage drop of a first power supplied from the first power source.

16. The organic light emitting display device as claimed in claim 14, wherein the data driver is configured to supply a data signal of the data signals having a voltage that is equal to or higher than that of the reference power source and lower than that of the first power source.

17. The organic light emitting display device as claimed in claim 14, further comprising a sixth transistor coupled between the driving transistor and the anode electrode of the organic light emitting diode and having a gate electrode coupled to the i-th light emission control line.

18. The organic light emitting display device as claimed in claim 14, wherein the second power source is configured to supply a high-level voltage during the second sensing period and low-level voltage during other periods.

19. An organic light emitting display device, comprising:

pixels at crossing regions of scan lines, light emission control lines, sensing lines, and data lines, each of the pixels comprising a driving circuit for providing a driving current substantially independent of a driving voltage supplied to a driving transistor of each of the pixels;

a sensor configured to extract deterioration information of organic light emitting diodes included in the pixels during a first sensing period and configured to extract threshold voltage and mobility information of driving transistors included in the pixels during a second sensing period;

a converter configured to generate corrected data by changing input data based on the deterioration information and the threshold voltage and mobility information extracted by the sensor;

a data driver configured to supply data signals to the data lines, the data signals being based on the corrected data during a driving period in which an image is displayed by the pixels and configured to supply reference data signals during the second sensing period; and a switching unit coupled to the data lines for selectively connecting the data lines with the data driver or the sensor, the switching unit comprising a sensing circuit configured to extract the deterioration information and the threshold voltage and mobility information, wherein, during the second sensing period, the sensor extracts the threshold voltage and mobility information of the driving transistor using second electric currents that are supplied from the pixels in response to the reference data signals, and wherein the sensing circuit comprises:

an electric current source coupled to a data line of the data lines and configured to supply a first electric current the data line during the first sensing period;

a third switching element coupled between the electric current source and the switching unit;

a sensing resistor configured to be supplied with a second electric current of the second electric currents from a corresponding one of the pixels; and a fourth switching element coupled between the sensing resistor and the switching unit.

20. An organic light emitting display device, comprising:

pixels at crossing regions of scan lines, light emission control lines, sensing lines, and data lines, each of the pixels comprising a driving circuit for providing a driving current substantially independent of a driving voltage supplied to a driving transistor of each of the pixels;

a sensor configured to extract deterioration information of organic light emitting diodes included in the pixels during a first sensing period and configured to extract threshold voltage and mobility information of driving transistors included in the pixels during a second sensing period;

a converter configured to generate corrected data by changing input data based on the deterioration information and the threshold voltage and mobility information extracted by the sensor; and a data driver configured to supply data signals to the data lines, the data signals being based on the corrected data during a driving period in which an image is displayed by the pixels and configured to supply reference data signals during the second sensing period, wherein, during the second sensing period, the sensor extracts the threshold voltage and mobility information of the driving transistor using second electric currents that are supplied from the pixels in response to the reference data signals, wherein the driving circuit comprises:

a first transistor coupled between a data line of the data lines and a first node and having a gate electrode coupled to a scan line of the scan lines;

a third transistor coupled between a first power source for supplying a reference power source and a second node and having a gate electrode coupled to the scan line;

a storage capacitor coupled between the first node and the second node;

a fourth transistor coupled between the first node and a second power source for supplying the driving voltage; and a second transistor coupled between the first power source and an anode electrode of an organic light emitting diode of the organic light emitting diodes.

* * * * *

US008519914C1

(12) EX PARTE REEXAMINATION CERTIFICATE (56th)

Ex Parte Reexamination Ordered under 35 U.S.C. 257

United States Patent
Kim

(10) Number: US 8,519,914 C1
(45) Certificate Issued: Jul. 19, 2016

(54) ORGANIC LIGHT EMITTING DISPLAY DEVICE

(75) Inventor: Yang-Wan Kim, Yongin (KR)

(73) Assignee: SAMSUNG DISPLAY CO., LTD.

Supplemental Examination Request:
No. 96/000,125, Dec. 4, 2015

Reexamination Certificate for:

| | |
|---|---|
| Patent No.: | **8,519,914** |
| Issued: | **Aug. 27, 2013** |
| Appl. No.: | **12/869,679** |
| Filed: | **Aug. 26, 2010** |

(30) Foreign Application Priority Data

Nov. 10, 2009 (KR) ..... 10-2009-0108082

(51) Int. Cl.
*G09G 3/30* (2006.01)
*G09G 3/32* (2016.01)

(52) U.S. Cl.
CPC ..... *G09G 3/3233* (2013.01); *G09G 3/3291* (2013.01); *G09G 2300/0819* (2013.01); *G09G 2300/0861* (2013.01); *G09G 2320/0285* (2013.01); *G09G 2320/0295* (2013.01)

(58) Field of Classification Search
None
See application file for complete search history.

(56) References Cited

To view the complete listing of prior art documents cited during the supplemental examination proceeding and the resulting reexamination proceeding for Control Number 96/000,125, please refer to the USPTO's public Patent Application Information Retrieval (PAIR) system under the Display References tab.

*Primary Examiner* — Angela M Lie

(57) ABSTRACT

An organic light emitting display device includes: pixels at crossing regions of scan lines, light emission control lines, sensing lines, and data lines; a sensor configured to extract deterioration information from organic light emitting diodes included in the pixels during a first sensing period and to extract threshold voltage and mobility information of driving transistors included in the pixels during a second sensing period; a converter configured to generate corrected data by changing input data based on the deterioration information and the threshold voltage and mobility information; and a data driver configured to supply data signals, the data signals being based on the corrected data during a driving period and being reference data signals during the second sensing period, wherein the sensor is configured to extract the threshold voltage and mobility information of the driving transistors using second electric currents from the pixels in response to the reference data signals.

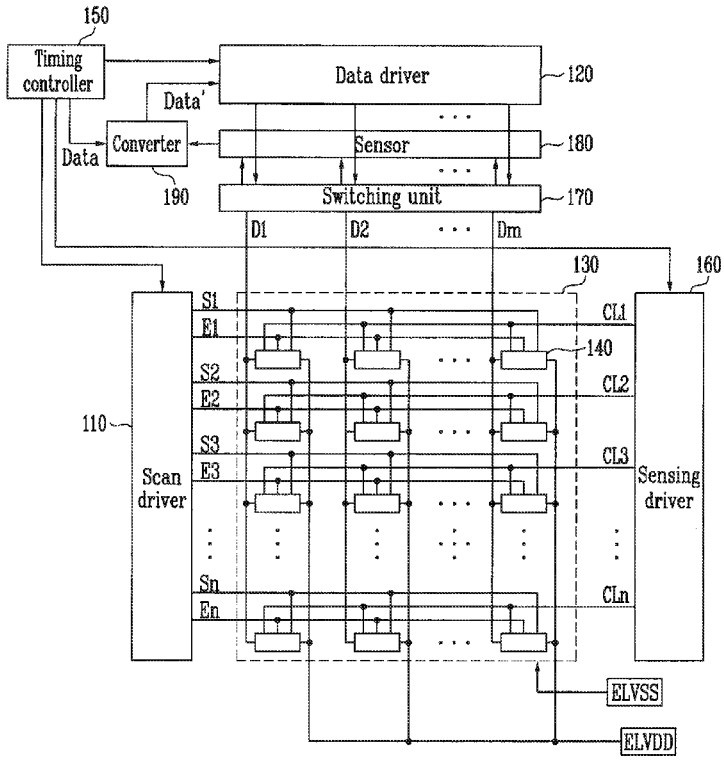

EX PARTE REEXAMINATION CERTIFICATE

NO AMENDMENTS HAVE BEEN MADE TO THE PATENT

AS A RESULT OF REEXAMINATION, IT HAS BEEN DETERMINED THAT:

The patentability of claims 1-20 is confirmed.

* * * * *